US005131819A

United States Patent [19]

Jubb

[11] Patent Number: 5,131,819

[45] Date of Patent: Jul. 21, 1992

[54] APPARATUS FOR AND METHOD OF MANAGING LIQUID UNDER PRESSURE

[75] Inventor: Albert Jubb, Kenilworth, United Kingdom

[73] Assignee: C.D.S.S. Limited, Norhamptonshire, United Kingdom

[21] Appl. No.: 601,684

[22] PCT Filed: Feb. 2, 1990

[86] PCT No.: PCT/GB90/00156

§ 371 Date: Oct. 23, 1990

§ 102(e) Date: Oct. 23, 1990

[87] PCT Pub. No.: WO90/09920

PCT Pub. Date: Sep. 7, 1990

[30] Foreign Application Priority Data

Feb. 25, 1989 [GB] United Kingdom ..... 8904348

[51] Int. Cl.[5] ..... B63G 8/36; F04B 9/10

[52] U.S. Cl. ..... 417/349; 60/371; 60/414; 417/394

[58] Field of Search ..... 60/716, 371, 413, 414; 417/394, 349

[56] References Cited

U.S. PATENT DOCUMENTS 4,326,380 4/1982 Rittmaster ..... 417/393

4,741,673 5/1988 Jubb ..... 417/394

*Primary Examiner*—Leonard E. Smith

*Attorney, Agent, or Firm*—Webb Burden Ziesenheim & Webb

[57] ABSTRACT

An apparatus for managing liquid under pressure having a first volume containing a liquid at a first pressure and a second volume containing liquid at a second, lower, pressure and energy storage means to receive and store energy derived from said first volume as a result of said first volume containing liquid under said first pressure and using said stored energy to increase the pressure in the second volume.

17 Claims, 3 Drawing Sheets

APPARATUS FOR AND METHOD OF MANAGING LIQUID UNDER PRESSURE

This invention relates to an apparatus for and a method of managing liquid under pressure.

An object of the invention is to provide a new and improved apparatus for and method of managing liquid under pressure.

According to one aspect of the present invention we provide an apparatus for managing liquid under pressure comprising a first volume adapted to contain liquid at a first pressure, a second volume adapted to contain liquid at a second, lower, pressure and means to receive and store energy derived from said first volume as a result of said first volume containing liquid under said first pressure and use said stored energy to increase the pressure in the second volume.

According to a second aspect of the invention we provide a method of managing liquid under pressure comprising the steps of receiving and storing energy derived from a first volume containing liquid at a first pressure with an energy storage means and subsequently using said stored energy to increase the pressure of liquid in the second volume.

The energy storage means may be adapted to receive and store energy derived from the strain energy of the first volume.

The energy storage means may convert said strain energy to kinetic energy.

Alternatively the energy storage means may transfer strain energy of said volume to a strain energy storage means in said device such as a coil or other spring or a pneumatic accumulator.

The energy storage means may comprise a rotatable energy storage member, means to rotate said member by means of a force derived from said energy of the first volume and means subsequently to cause continuing rotation of the rotatable member to provide a force to pressurise the second volume.

The liquid of the first volume may act on a piston movement of the piston being utilised to rotate the energy storage member.

Said continuing rotation of the energy storage member may move a pressurising piston to cause the piston to impose a pressurising force on the liquid of the second volume.

The pressurising piston may drive the rotatable member through a rack provided on the piston in engagement with a pinion drivingly connected to the rotatable member.

The rotatable member may drive the pressurising piston by virtue of a rack provided on the pressuring piston in engagement with a pinion driven from the rotatable member.

A common rack and pinion may be provided, the rack having at one end a driven piston in driving relationship with the liquid of the first volume and at the other end the pressurising piston in pressurising relationship with the liquid of the second volume.

Alternatively, a piston in driving relationship with the liquid of the first volume may be adapted to move a ball screw in threaded engagement with a drive screw connected to the rotatable member and the pressurising piston may be driven by a similar mechanism and, preferably, a common ball screw and connection to the rotatable member is provided for the two pistons.

Further alternatively, a hydraulic motor may be provided to rotate the rotatable member and a hydraulic motor may be driven by the rotatable member to pressurise the second volume.

Means may be provided to vary the inertia and/or speed of rotation of the rotatable member, for example, by providing the rotatable member in a plurality of parts, the parts being selectively connectable in driving or driven relationship and/or the gear ratio may be changed.

From a more specific aspect the invention relates to an apparatus for and a method of transferring liquid between regions of a first and a second pressure in which a volume is alternated between a first mode in which it is isolated from one of said regions and connected to the other of said regions and a second mode in which it is isolated from said other region and connected to said one region.

Our GB Patent No. 2158889 discloses one such arrangement and whilst the arrangement is economical in terms of the energy consumption required for operation thereof compared with the energy needed to transfer liquid between the regions used in motor driven pumps, an energy loss occurs due to the liquid being compressed in the region of high pressure compared with its volume in the region of low pressure and, to a lesser extent, due to enlargement of the volume due to deformation of the walls of a chamber in which the volume is defined when the chamber is connected to the region of high pressure compared to the volume when the chamber is connected to the region of low pressure.

Both of these result in a larger mass liquid within the volume when at a higher pressure than at lower pressure. Therefore, when the volume is filled with liquid and connected to the higher pressure region and is then isolated from the higher pressure region, a small quantity of liquid has to be allowed to escape before the pressure can drop to that of the lower pressure region. As a result each time a charge of liquid passes from the higher pressure region to lower pressure region more liquid passes than the amount entering from the lower pressure region and discharged to the higher pressure region. The energy involved in this process is half the product of the volume change and the pressure change. With high pressure difference, such as would occur with the transfer of liquid between the interior and exterior of a pressure wall immersed at depth in a body of water whilst a region within the pressure wall is maintained at approximately one atmosphere, or the energy loss is significant.

If this energy is dissipated rapidly, for example, in a turbulent flow pattern, a significant fraction of this energy is converted to acoustic energy within the liquid itself and this, in general, is undesirable.

An object of the more specific aspect of the present invention is to provide an apparatus for and a method of transferring liquid between regions of a first and second pressure whereby the above mentioned disadvantages are overcome or are reduced.

According to a more specific aspect of the present invention we provide an apparatus and method according to the first and second aspects of the invention wherein the apparatus is adapted to transfer liquid between regions of a first and a second pressure and comprises means to alternate the first volume between a first mode in which it is isolated from one of said regions and connected to the other of said regions and a second mode in which it is isolated from said other region and connected to said one region, means to alternate the second volume between a first mode in which the second volume is isolated from said one region and is connected to said other region and a second mode, in which the second volume is isolated from said other region and connected to said one region, said means to alternate the volumes being arranged so that when the first volume is in its first mode the second volume is in its second mode and when the first volume is in its second mode the second volume is in its first mode, said energy storage means being adapted to receive and storage energy derived from the liquid in the volume initially at higher pressure and means to use said stored energy to pressurise the volume initially at lower pressure.

According to another more specific aspect of the invention we provide an apparatus and method according to the first and second aspects of the invention wherein the apparatus is adapted to transfer liquid between regions of a first and a second pressure and the sizes of said volumes can be changed by a member associated with each volume, means being provided alternately to connect the volumes to one of said regions and to compensate for the resultant forces exercised on the members by the medium in said regions with a counterforce of substantially the same size or a lock system, the energy storage means being adapted to receive and store energy derived from the liquid in the volume initially at higher pressure and means to use said stored energy to pressurise the volume initially at lower pressure.

The member may be acted upon by an energy accumulator which exerts a force thereon which is substantially equal to the resultant force exerted thereon by the medium.

Preferably the first volume has a first companion volume connected to the same region as the first volume and the second volume has a second companion volume connected to the same region as the second volume and wherein the sizes of each volume and associated companion volume can be simultaneously changed in the opposite direction.

According to another more specific aspect of the invention we provide an apparatus and a method according to the first and second aspects of the invention wherein the apparatus is adapted to transfer liquid between regions of a first and a second pressure and comprises means for isolating the first volume and a first companion volume from one of said regions and then placing said volumes in communication with the other of said regions, causing liquid from said other region to enter into the first volume and displacing, from the companion volume into said other region, liquid which has previously entered the companion volume from said one region; isolating the first volume and the first companion volume from said other region and then placing said first volumes in communication with said one region and then displacing, from said first volume into said one region, liquid which has previously entered said first volume from said other region and causing liquid from said one region to enter into the first companion volume, performing a similar and opposite sequence in respect of the second volume and a second companion volume, said energy storage means being adapted to receive and store energy derived from the liquid in a volume initially at higher pressure and means to use said stored energy to pressurise a volume initially at lower pressure.

Said means for each volume and companion volume may comprise a vessel, a dividing member in the vessel, the vessel and the dividing member being relatively movable to divide the vessel into separate variable volume chambers, a first pair of valves, one of which controls passage of liquid between a first of said chambers and said one region, and the other which controls passage of liquid between a second of said chambers and said first region, a second pair of valves, one of which controls passage of liquid between said first chamber and said second region, the other of which controls passage of liquid between said second chamber and said second region, operating means repeatedly to perform the following cycle of operations; close the valves of one of said pairs and open the valves of the other of said pairs, then move the dividing member to cause the volume of said first chamber to increase and the volume of said second chamber to decrease, then close the valves of the other of said pairs and open the valves of said one pair, and then move the dividing member to cause the volume of said first chamber to decrease and the volume of said second chamber to increase.

The means may comprise an apparatus as described and claimed in our UK Patent 2158889, the content of which is incorporated herein by reference.

Figure 1:
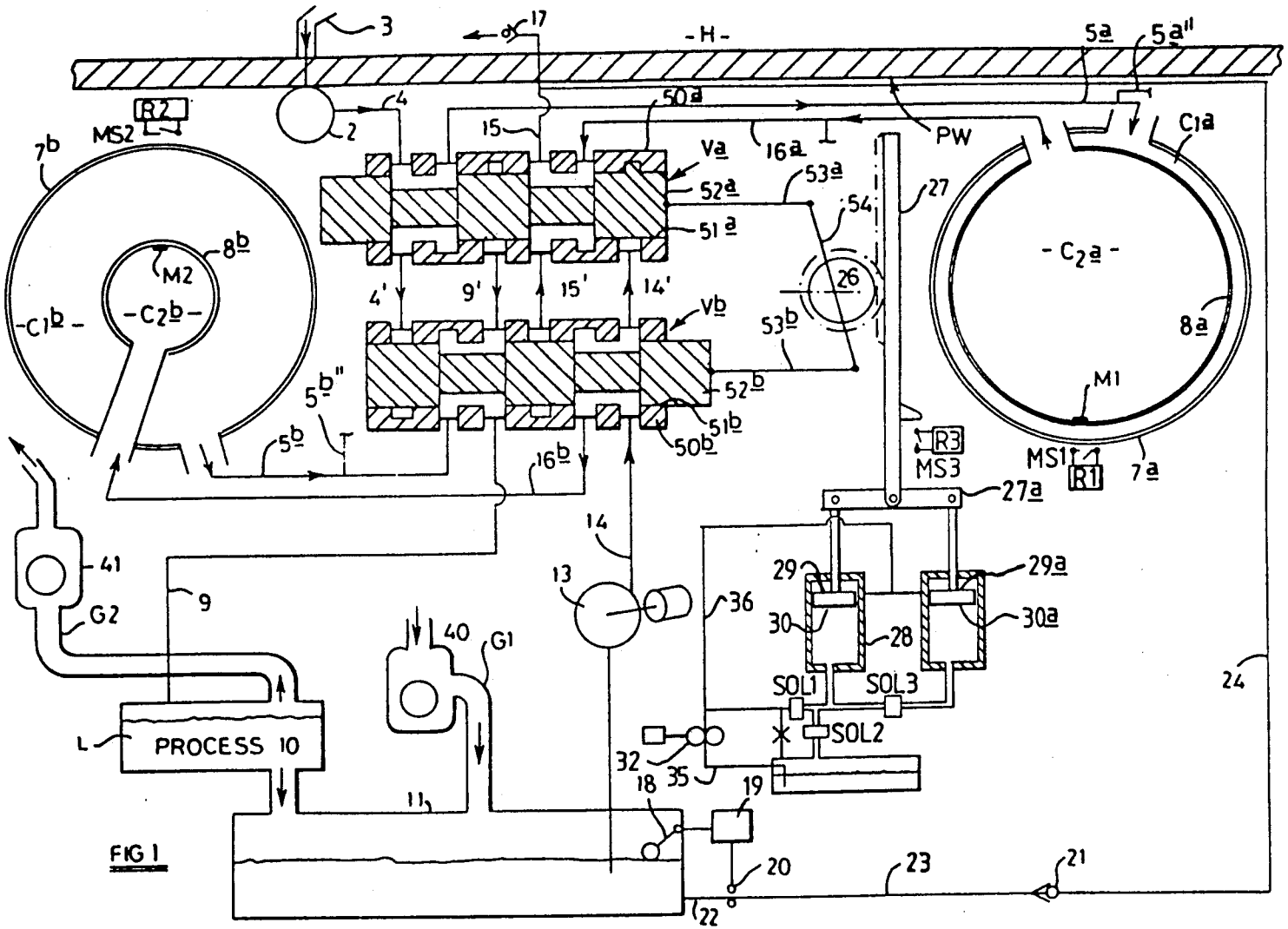
FIG. 1 is a diagrammatic illustration of an embodiment of the invention, showing one condition of operation.
Figure 2:
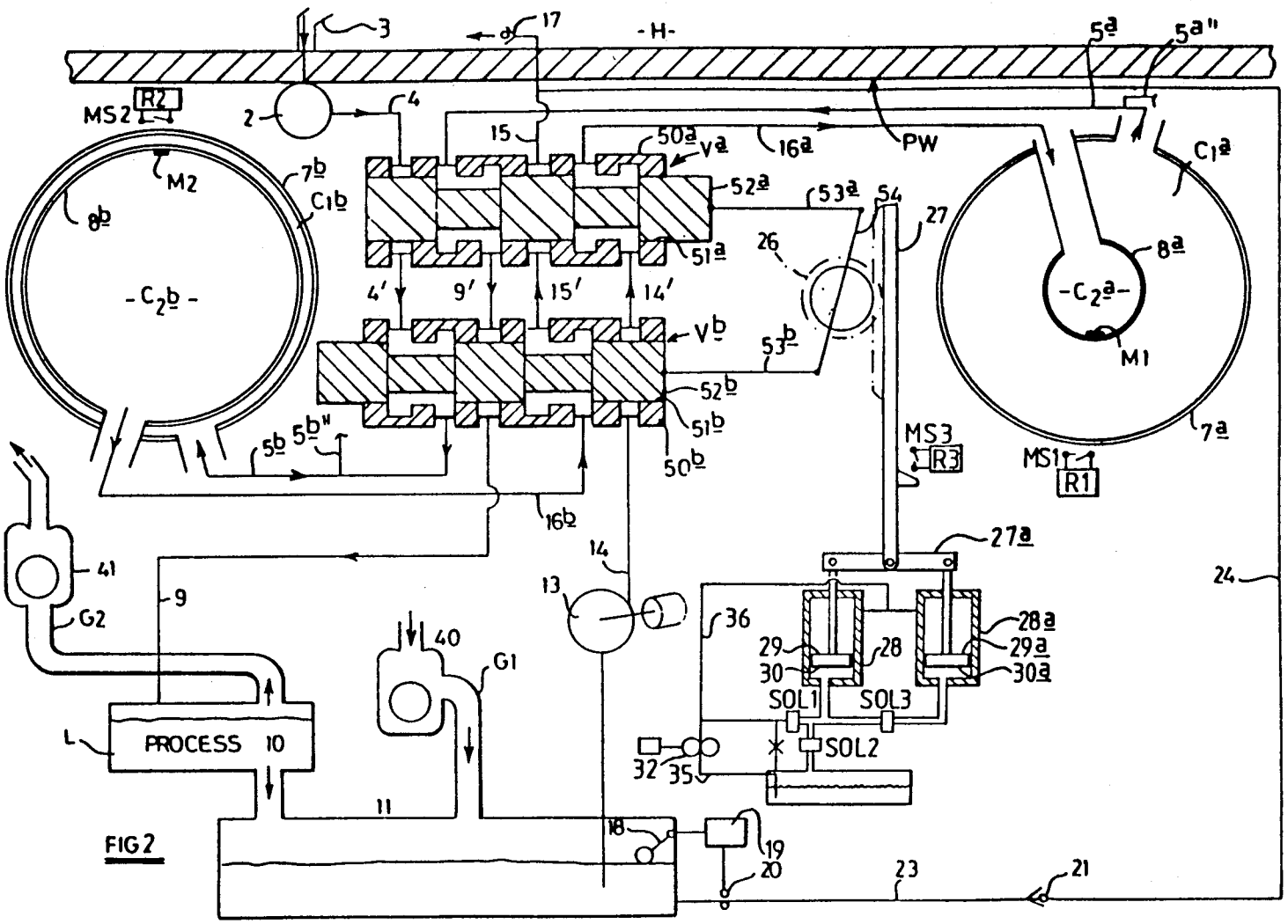
FIG. 2 is a view similar to that of FIG. 1 but showing a different condition of operation of the embodiment.

Referring now to FIGS. 1 and 2, liquid, in the present example water, is to be transferred from a region H at high pressure on one side of a pressure wall PW to a region L of low pressure on the opposite side of the wall PW. In the present example the pressure wall PW comprises part of the pressure hull of a submarine vessel and the region L is a region where a cooling operation is performed by placing the water in heat transfer relationship with an apparatus to be cooled, but if desired the water may be used for any other purpose, such as gas absorbtion or gas desorbtion. In the present example, the pressure obtaining in the region L is the same as the pressure obtaining in the whole of the region on the opposite side of the pressure wall PW to the high pressure region H. However, if desired, the pressure in the region L may be different from the pressure externally of the region L as well as, of course, being different from the pressure in the region H. Thus, the apparatus hereinafter described transfers liquid between regions of a first and second pressure, in the present example the first pressure region being a relatively high pressure and the second pressure region being a relatively lower pressure than the pressure in the high pressure region.

Water from the region H is taken in through a conduit 1 by means of a pump 2. Alternatively, if desired, particularly in the case where there is relative movement between the region H and the pressure wall PW, the water can be taken in through a ram intake indicated in dotted outline at 3. The water then passes via a conduit 4 to a valve means Va, Vb, hereinafter to be described, operable by means of a shift 25 driven by a pinion 26 rotated by a rack 27.

The apparatus comprises two vessels *7a, 7b* each of which comprises a rigid sphere made of non-magnetic material having disposed therein a flexible dividing member made, for example, of rubber or other suitable deformable material. The dividing member 8a, 8b divides each vessel 7a, 7b into a first, outer volume or chamber C1a, C1b and a second, inner volume or chamber C2a, C2b. The first chamber C1a, C1b of each vessel 7a, 7b is connected by a conduit 5a, 5b to the valve means Va, Vb and each inner or second chamber C2a, C2b is connected by conduit 16a, 16b to the valve means Va, Vb.

With this two vessel arrangement water is extracted from and delivered to the high pressure region by one vessel simultaneously with extraction from and delivery to the low pressure region of water from the other vessel.

Alternatively the vessels may each be divided into first and second chambers by a piston slidably and sealingly mounted in the vessel which thereby provides a cylinder. Alternatively, instead of a slidable piston, the vessels may be divided into first and second chambers by means of some other form of dividing member such as a diaphragm. If desired, the vessel and dividing member may be provided by other means such as a rotary piston and housing arrangement or a vane type device, suitable means being provided to cause relative rotation of the piston/vane and its associated housing. Suitable means may be provided to drive the dividing member to transfer liquid into and out of the associated chambers as well as or instead of the liquid pumps described hereinafter.

Each valve means Va, Vb is essentially similar and comprises a valve body 50a, 50b having an axial bore 51a, 51b therein to receive a rectilinearly slidable valve member 52a, 52b which are caused to reciprocate rectilinearly in opposite directions by means of rods 53a, 53b connected to opposite ends of a lever 54 caused to rotate by a pinion 26 which meshes with a rack 27 as described in connection with the first embodiment. The valve bodies 50a, 50b are provided with four ports. The valve body 50a having ports connected to conduits 4, 5a, 15 and 16a and body 50b having ports connected to conduits 5b, 9, 16b and 14. In addition, the valve bodies 50a, 50b are inter-connected by conduits 4', 9', 14', 15'. It will also be noted that the valve bodies 50a, 50b are provided with annular passages in axial alignment with each port to permit of fluid flow circumferentially around the associated valve members 52a, 52b.

The ports of the valve means Va connected to conduits 4 and 5a together with the valve member 52a provide one valve of a first pair of valves associated with the vessel 7a to control passage of water between the chamber C1a of the one vessel 7a and the high pressure region H. The ports of the valve means Va connected to conduits 15 and 16a together with the valve member 52a provide the other valve of the first pair of valves which controls passage of water between the chamber C2a and the high pressure region H.

The ports of the valve means Va connected to the conduits 5a and 9' which is connected through valve means Vb to conduit 9, together with the valve member 52a provide one valve of a second pair of valves which controls passage of water between the chamber C1a and the region of low pressure L. The ports of the valve means Va connected to the conduits 16a and 14' which is connected through valve means Vb to conduit 14 together with the valve member 52a provide the other valve of the second pair of valve which controls passage of water between the chamber C2a and the low pressure region L.

Similarly, with regard to the vessel 7b, the ports of the valve means Vb connected to the conduits 5b and 4' which is connected through valve means Va to conduit 4 together with valve member 52b provides one valve of a first pair of valves, associated with the chamber 7b, which controls passage of water between chamber C1a and the region of high pressure H. The ports of the valve means Vb connected to conduits 16a and 15' which is connected through valve means Va to conduit 15, together with valve means 52a, provides the other valve of the first pair of valves which controls passage of water between the chamber C2b and the region of high pressure H The ports of the valve means Vb connected to the conduits 5b and 9 together with the valve means 52b provide one valve of a second pair of valves which controls passage of water between the chamber C1b and the region of low pressure L. The ports of the valve means Vb connected to the conduits 16b and 14 together with the valve member 52b provide the other valve of the second pair of valves which controls passage of water between the chamber C2b and the low pressure region L.

Although in this example the valve means Va and Vb have been interconnected by conduits 4', 9', 14' and 15', it will be seen that the valve means Va has no affect on flow of water between the conduits 4 and 4' and the conduits 15 and 15' whilst the valve means Vb has no affect on the flow of water between the conduits 9 and 9' and 14 and 14'. Hence, if desired, instead of said interconnection, the conduits 4 and 15 could be provided with a branch which bypasses the valve means Va and extends directly to the ports of the valve means Vb shown connected to the conduits 4', 15' and similarly the conduits 9 and 14 could be provided with a branch which extends directly to the valve means Va being connected thereto at the ports shown connected to the conduits 9' and 14'. However, the above described inter-connection of the valve means together with the annular passages associated with each port permits of a more compact and convenient valve assembly.

The conduit 9 extends to the low pressure region L, e.g. a process volume 10, where a desired cooling, gas absorbtion, desorbtion or other process takes place. Water flows from the process volume 10 to a reservoir 11 from which the water is sucked via a conduit 12 by a pump 13 and is delivered by a conduit 14, to the valve means Va, Vb.

The reservoir 11 may be provided with a float controlled switch 18 which operates a motor 19 which drives a small flow, high pressure, pump 20 to collect any excess water which accumulates in the reservoir 11 as a result of small leaks and expels it via conduits 22 and 23, non-return valve 21, conduit 24, conduit 15 and non-return valve 17 to the high pressure region H. As soon as the level of the water in the reservoir 11 falls to a desired value, the flow control switch 18 opens and operation of the pump 20 stops and the valve 21 closes.

The shaft 25 is rotated as a result of reciprocation of the rack 27 caused by a rocking lever 27a driven by a pair of differential area pistons 29, 30 and 29a, 30a sliding in a cylinder 28, 28a with suitable sliding seals. Oil is fed from an oil reservoir 33 via conduit 35 by a pump 32, driven by a motor 31, which discharges high pressure oil to a conduit 36 at a pressure level set by pressure control means indicated at 34. For example a pressure release valve. The high pressure oil in the conduit 36 is fed to act on the smaller area sides 29, 29a of the differential area pistons. The larger area side 30 of one of the pistons is fed from the centre point P of two solenoid operated valves SOL1 and SOL2. The larger area side 30*a* of the other of the pistons is fed from the centre point P but via a third solenoid valve SOL3.

The dividing members 8*a* and 8*b* carry magnets M1, M2 to operate reed switches MS1 and MS2 respectively, located outside the vessels 7*a*, 7*b* being made of non-magnetic material.

In use, with the valve means Va, Vb in the position shown in FIG. 1, water flows via conduit 4 from high pressure region H via valve means Va into conduit 5*a* and hence into chamber C1*a* of vessel 7*a* to cause contraction of the dividing member 8*a* and thus expulsion of water already in chamber C2*a* (which has been delivered thereinto previously from the low pressure region L) via conduit 16*a* and valve means Va and conduit 15 into the high pressure region H. At the same time water is pumped by pump 13 from low pressure region L via conduit 14, valve means Vb and conduit 16*b* into chamber C2*b* of vessel 7*b* resulting in expansion of the dividing member 8*b* and thus expulsion of water already in chamber C1*b* (which has previously entered C1*b* from the region of high pressure) via conduit 5*b*, valve means Vb and conduit 9 into the low pressure region L.

As the dividing member 8*a* of vessel 7*a* moves inwardly, it takes the magnet M1 away from the reed switch MS1 and as the magnet M2 is brought close to reed switch MS2 by expansion of the dividing member 8*b* of the vessel 7*b*, the relay R2 is energised to (a) cancel the engagement of the relay R1 to interrupt the electrical supply to the solenoid valve SOL1;

(b) operate a "hold-on" through the secondary winding of the relay R2 which is brought into operation with the cancelling of R1;

(c) provide an electrical supply to the solenoid valve SOL2 so that the solenoid valve SOL1 is closed and the solenoid valve SOL2 opened so that the differential piston 29, 30 moves downwardly from the position shown in FIG. I to that shown in FIG. 2 so moving the rocking lever 27*a* to an inclined position and hence moving the rack 27 partly downwardly to rotate the pinion 26 to move the valve members 52*a* and 52*b* from the position shown in FIG. 1 to an intermediate position in which water flow is prevented. This downward movement of the rack 27 operates a microswitch MS3 to energise a relay R3 to start a timing device T so that after a predetermined time, sufficient for the above described energy transfer means to operate, the solenoid valve SOL3 opens so that the piston 29*a*, 30*a* moves downwardly to the position shown in FIG. 2 and so moves the rocking lever 27*a* to a lower position and hence moves the rack 27 and hence the valve members 52*a*, 52*a* to the positions shown in FIG. 2, rotating the pinion 26 and moving the valve members 52*a* and 52*b* from the position shown in FIG. 1 to that shown in FIG. 2.

Thus, referring now to FIG. 2, water now flows from high pressure region H via conduit 4 through valve means Va and via conduit 4' and valve means Vb into chamber C1*b* through conduit 5*b* to compress the dividing member 8*b* therein and so expel the water (which had entered chamber C2*b* from the region of low pressure as described above in connection with FIG. 1), via conduit 16*b*, valve means Vb, conduit 15', valve means Va and conduit 15 to enter the region of high pressure H. At the same time water from the low pressure region L is pumped by pump 13 via conduit 14, valve means Vb, conduit 14', valve means Va into chamber C2*a* of vessel 7*a* to cause the dividing member 8*a* thereof to expand and to expel water in the chamber C1*a*, (which previously entered that chamber from the region of high pressure as described above in connection with FIG. 1) via conduit 5*a*, valve means Va, conduit 9', valve means Vb and conduit 9 into the region of low pressure L. The contraction of the dividing member 8*b* moves the magnet M2 away from the reed switch MS2 and the expansion of dividing member 8*a* moves the magnet M1 towards the reed switch MS1 so as to energise the relay R1 to cause solenoid valve SOL1 to open, solenoid valve SOL2 to shut and solenoid valve SOL 3 to shut. As a result, the piston 29, 30 moves upwardly to the position shown in FIG. 1, whilst the piston 29*a*, 30*a* does not move. As a result, the rocking lever 27*a* moves to an inclined position to move the rack 27 so that the valve members 52*a*, 52*b* move to the above described intermediate position in which all flow is prevented. This intermediate movement of the rack 27 causes the microswitch MS3 and relay R3 to again start the timer device T so that after an appropriate time, for the energy storage device to operate, the timer switch T opens solenoid valve SOL3 so that the piston 29*a*, 30*a* moves to the position shown in FIG. 1 and hence the rack 27 is moved fully upwardly to move the valve members 52*a*, 52*a* to the position shown in FIG. 1. The above described sequence of operation is then repeated. If desired, the rectilinear valve means may be replaced by suitable numbers of ball or other type valve means.

The rates of movement of the dividing members 8*a*, 8*b* are controlled as follows:

Movement inwardly is controlled by the pressure exerted by the pump 2 or the ram intake 3.

Movement outwardly is controlled by the pump 13 and pressure drop in the process volume 10 and in the various valves and conduits etc.

Therefore the net rates of flow and speed of cycling are controlled primarily by the pump 13 and the pump 13 may be controlled as desired.

At low flow rates it may be convenient to incorporate a throttling orifice downstream of the pump 13 to linearise and stabilise the relationship between flow and speed. If desired, other means may be provided to move the dividing member as mentioned hereinbefore.

In order to commence operation of the apparatus, relay R1, or relay R2 as desired, is engaged by means of a manually operated contact which simulates the operation of magnetic switch MS1 or MS2. The system may be stopped deliberately in this condition by the manual operation, e.g. push button stop, of a break in the electric circuit from switch MS1 or MS2 to relay R1 or R2.

Because mechanical failure of the valve seals, hereinafter to be described within the valve means V1 or V2 can allow a large flow of water from the high pressure region H into the process volume 10 and the reservoir 11 such that the small return pump 20 could not cope, the connections of the process volume 10 and reservoir 11 to apparatus the water is intended to be used in connection with, in the present example inlet and outlet connections for gas, are provided with float valves 40, 41 arranged so that flooding of the process volume 10 and reservoir 11 results in water rising in the float valves which therefore isolate the gas system from flooding independently of the rest of the system.

The conduit 5*a* connected to the chamber C1*a* is provided with a branch conduit 5*a*" and the conduit 5*b* connected to the chamber C1*b* provided with a branch conduit 5*b*".

Figure 3:
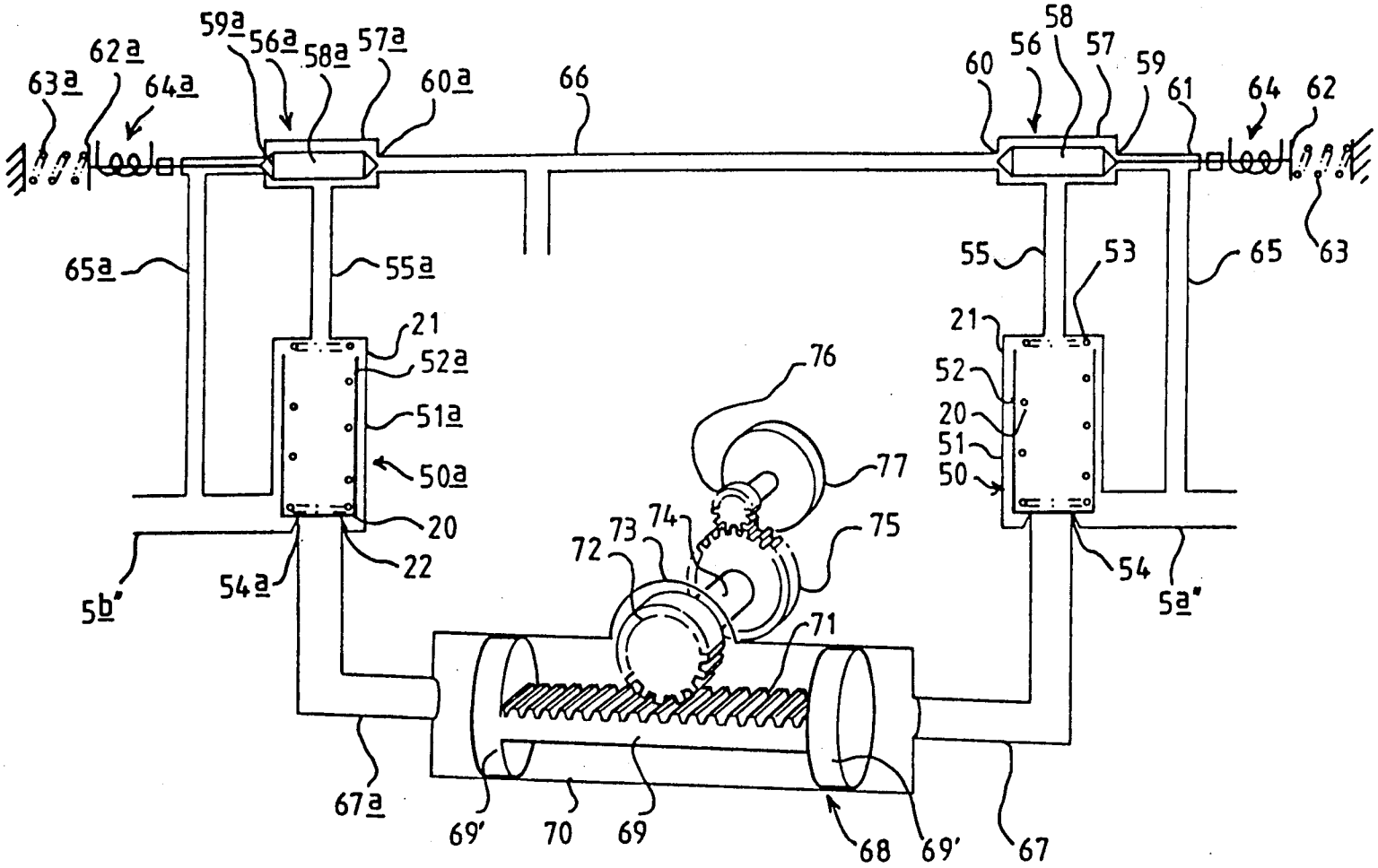
FIG. 3 is a diagrammatic illustration of an energy storage means of the apparatus of FIGS. 1 and 2.

The conduits 5a" and 5b" are connected to an energy storage device 68 as shown in FIG. 3.

The conduit 5a" extends to a valve 50 comprising a valve chamber 51 housing a valve member 52 resiliently biased by a coil compression spring 53 into sealing engagement with a valve seat 54. The valve chamber 51 is connected by a conduit 55 to a double cone valve 56 comprising a housing 57 in which a valve member 58 having a cone shaped portion at each end is reciprocable into alternate sealing engagement with valve seats 59, 60. The member 58 has a connecting rod 61 having a head 62 engaged by a coil compression spring 63 normally to bias the member 58 into sealing engagement with the seat 60 and there being a solenoid 64 operable to move the member 58 out of sealing engagement with the seat 60 and into sealing engagement with the seat 59. A bypass pipe 65 links the interior of the housing 57 and the conduits 5a", 15a".

A similar valve arrangement 50a is provided for the conduit 5b" and the same reference numerals have been used in FIG. 3 which refer to corresponding parts but with the addition of an a.

A conduit 66 links the housings 57, 57a and is connected to a region of low pressure such as the interior of the pressure wall P. A conduit 67 extends from the valve seat 54 to an energy storage device 68 whilst a conduit 67a extends from the valve seat 54a to the energy storage device 68.

In the present example the energy storage device 68 comprises a double piston assembly 69 slidable in a cylinder 70. The double piston assembly has a rack 71 engaged with a pinion 72 housed within an extension part 73 of the cylinder 70 and connected by a shaft 74, through a fluid tight seal in the wall of the extension part 73 with a further pinion 75 which meshes with a smaller pinion 76 or other suitable gear mechanism to drive a fly wheel 77 at an appropriate speed.

The operation of the apparatus will now be described, assuming that low pressure exists in the chamber C1a and high pressure in the chamber C1b whilst low pressure exists in the chamber C2a and high pressure in the chamber C2b. Low pressure will obtain in the conduit 5a" of the respective energy storage system, whilst high pressure will obtain in the conduit 5b".

In the energy storage system high pressure liquid from the conduit 5b" leaks past the piston 52a into the interior of the chamber 51a above the piston and so ensures that the piston 52a is maintained in sealing engagement with the seat 54a so long as the exit from the chamber 51a through the conduit 55a is blocked by the member 58a being in engagement with the seat 60a which is normally the case because of the biasing effect of the spring 63a.

At the same time the space above the piston 52 is similarly closed by the member 58 being spring biased by the spring 63 into engagement with the seat 60.

Upon energization of the solenoid 64a the member 58a is moved out of sealing engagement with the seat 60a so that the pressure above the pistion 52a acting thereon is relieved through conduit 66 and so the piston is moved upwardly by the pressure of the liquid out of engagement with the seat 54a so that liquid under pressure passes through conduit 67a to act on one piston 69' of the piston assembly 69 to cause the piston assembly 69 to move to the right and thus rotate the fly wheel 77. The liquid in the conduit 67, which is, at this stage, at low pressure, is permitted to be displaced therethrough by virtue of the valve member 52 being lifted by the pressure of fluid out of engagement with the valve seat 54 so that the liquid enters into the conduit 5a" so enters the associated chamber C1a.

As the pressure in the conduit 67a falls towards a median pressure between the pressures in the associated chambers C1b, C1a or C2b, C2a, the energy imparted to the fly wheel 77 and stored therein by its rotation reaches a maximum when the pressures are equal. Thereafter the energy is withdrawn from the fly wheel by virtue of the fly wheel continuing to drive the piston assembly 69 to the right to pressurise the liquid in the conduit 67 and hence in the conduit 5a" of the associated system and hence in the associated chambers C1a.

When all the energy in the fly wheel is exhausted and movement of the piston assembly 69 arrested so that flow of liquid in the conduit 67 stops, the spring 53 pushes the piston 52 downwardly onto the seat 54 so that the valve acts as a non-return valve preventing liquid from reversing its flow direction.

To ensure more consistent operation, the conduits 65 and 65a are provided so that a known pressure acts upon the spring side of the pistons 52, 52a.

The solenoid 64a is de-energized so that both solenoids 64, 64a are in a de-energized state and so that the valve members 58, 58a are in sealing engagement with the seats 60, 60a respectively before the main flow valves Va, Vb are operated.

After such operation of the main flow valves Va, Vb, the chambers C1a and C2a will be subjected to the region of high pressure and the chambers C1b, C2b will be subjected to the region of low pressure and then the above described sequence of operations is performed in reverse by energising the solenoid 64 to move the valve member 58 out of sealing engagement with the seat 60 so that the closing pressure acting upon the valve member 52 is relieved and the valve member 52 is caused to move away from the valve seat 54 to permit liquid under pressure to pass through the conduit 67 to act upon the piston 69" to move the piston assembly 69 to the left in FIG. 3 to cause the fly wheel 77 to again rotate this time in the reverse direction.

Again, initial movement of the piston assembly 69 is under the driving effect of the liquid in the conduit 67 whilst thereafter continued movement of the piston assembly 69 to transfer liquid from the conduit 67a into the associated chamber C1b, C2b is by virtue of extraction of the energy stored in the fly wheel 77. When flow through the conduit 67a ceases the piston 52a moves into sealing engagement with the seat 54a to act as a non-return valve and then the solenoid 64 is deenergised whilst the main valves Va, Vb are operated to connect the chambers C1b, C2b to the region of high pressure and the chambers C1a, C2a to the region of low pressure and this sequence of operations is repeated.

Upon pressure decrease or increase by virtue of operation of the energy storage system on one side of the dividing member of each chamber, the dividing member will move so that there is a corresponding change in pressure on the other side of the dividing member and hence it is unnecessary to provide an energy storage device between the lines 16a and 16b.

If desired, however, such a second energy storage device may be provided between the lines 16a and 16b and would operate in exactly the same way as the energy storage device described hereinbefore.

Instead of pistons slidable in cylinders other equipment means may be provided such as diaphragms, rotatable vanes and the like, all of which are referred to herein generally as pistons.

The piston and fly wheel arrangement described hereinbefore is only one of a plurality of means of carrying out the invention of transferring energy from one volume or chamber and transmitting this to a second volume or chamber. Other mechanical storage devices may be provided such as a pair of opposed pistons which produce axial movement of a ball screw nut which turns a screw fastened to the fly wheel or by using a hydraulic motor to drive the fly wheel.

The fly wheel inertia can be adjusted to different values for different conditions, for example, different changes in pressure, so that the time in which the system operates can be altered as desired.

As the pressure difference is first applied to the piston assembly, the piston travel is small and the pressure reduction is small but as the two pressures on opposite sides of the piston assembly come closer together the fly wheel speeds up to a maximum at which the maximum energy to be transferred has been stored in the fly wheel and the pressures in each volume or chamber are equal and halfway to their final values. After this the fly wheel energy is returned to the piston assembly so that the pressure in the initially low pressure volume or chamber is increased to nearly the pressure in the initially high pressure volume or chamber and the fly wheel then stops.

The rate of pressure change may be controlled, for example, for minimizing acoustic energy, in accordance with the pressure differential. For example, at low pressure differentials for a given rate of pressure change a smaller fly wheel may be used to give a smaller moment of inertia than would be used with higher pressure differences. It will be appreciated that with higher pressure differences a longer period of time for piston movement would take place, although with the same maximum rate of change of pressure. Such adjustment may be achieved by providing mechanical clutches between one or more fly wheels or by changing gear ratio or by any other suitable means. If desired other energy storage means may be provided, such as a mechanical spring or a gas accumulator.

This system is adequate for clean liquids, which have some lubricating properties, and are not significantly abrasive.

For other liquids, and for liquids containing abrasives which cause wear, or cause silting up of the various parts between conduits 10 and 13 a displaceable flexible diaphragm of suitable impervious material can be provided in the conduits 5*a*″ and 5*b*″, with the dirty liquid on the side thereof connected to the volumes or chambers and a clean convenient liquid on the sides connected to the valves, and the energy storage device. Accordingly the latter system is a substantially closed hydraulic system. Such a fluid might well be a conventional light hydraulic oil.

The displacement volumes of the diaphragms must clearly be larger than the swept volumes of the piston pair.

It should also be noted that by reasonable design it should be practicable to transfer at least 80% of the possible strain energy to the opposite volume—i.e. the pressure rise would be 90% or more theoretically perfect possible.

If it is desired also to reduce sudden noise associated with sudden pressure changes, a further final pressure changing operation may be desirable to complete the process of adjusting pressures more slowly than a sudden change after most of the energy has been transferred.

The features disclosed in the foregoing description, or the accompanying drawings, expressed in their specific forms or in terms of a means for performing the disclosed result, as appropriate, may, separately or in any combination of such features, be utilised for realising the invention in deverse forms thereof.

I claim:

1. An apparatus for transferring liquid between regions of a first pressure and a second pressure, said regions being external to the apparatus, the apparatus comprising a first volume, means to connect said first volume to one of said regions, a second volume, means to connect said second volume to the other of said regions, isolating means to isolate said volume from said regions while connecting means connect an energy storage means to said volumes to receive and store energy from said one volume as a result of said one volume containing liquid at said first pressure and to use the stored energy to increase the pressure in the other volume.

2. An apparatus as claimed in claim 1 comprising means to alternate the first volume between a first mode in which it is isolated from one of said regions and connected to the other of said regions and a second mode in which it is isolated from said other region and connected to said one region, means to alternate the second volume between a first mode in which the second volume is isolated from said one region and is connected to said other region and a second mode, in which the second volume is isolated from said other region and connected to said one region, said means to alternate the volumes being arranged so that when the first volume is in its first mode the second volume is in its second mode and when the first volume is in its second mode the second volume is in its first mode, said energy storage means being adapted to receive and store energy derived from the liquid in the volume initially at higher pressure and means to use said stored energy to pressurize the volume initially at lower pressure.

3. An apparatus as claimed in claim 1 wherein the sizes of said volumes can be changed by a member associated with each volume, means being provided alternately to connect the volumes to one of said regions and to compensate for the resultant forces exercised on the members by the medium in said regions with a counterforce of substantially the same size or a lock system, the energy storage means being adapted to receive and store energy derived from the liquid in the volume initially at higher pressure and means to use said stored energy to pressurize the volume initially at lower pressure.

4. An apparatus as claimed in claim 3 wherein the member is acted upon by an energy accumulator which exerts a force thereon which is substantially equal to the resultant force exerted thereon by the medium.

5. An apparatus as claimed in claim 3 wherein the first volume has a first companion volume connected to the same region as the first volume and the second volume has a second companion volume connected to the same region as the second volume and wherein the sizes of each volume and associated companion volume can be simultaneously changed in the opposite direction.

6. An apparatus as claimed in claim 1 comprising means for isolating the first volume and a first companion volume from one of said regions and then placing said volumes in communication with the other of said regions, causing liquid from said other region to enter into the first volume and displacing, from the companion volume into said other region, liquid which has previously entered the companion volume from said one region; isolating the first volume and the first companion volume from said other region and then placing said first volumes in communication with said one region and then displacing, from said first volume into said one region, liquid which has previously entered said first volume from said other region and causing liquid from said one region to enter into the first companion volume, performing a similar and opposite sequence in respect of the second volume and a second companion volume, said energy storage means being adapted to receive and store energy derived from the liquid in a volume initially at higher pressure and means to use said stored energy to pressurize a volume initially at lower pressure.

7. An apparatus as claimed in claim 6 wherein each volume and companion volume comprises a vessel, a dividing member in the vessel, the vessel and the dividing member being relatively movable to divide the vessel into separate variable volume chambers, a first pair of valves, one of which controls passage of liquid between a first of said chambers and said one region, and the other which controls passage of liquid between a second of said chambers and said one region, a second pair of valves, one of which controls passage of liquid between said first chamber and said other region, the other of which controls passage of liquid between said second chamber and said other region, operating means repeatedly to perform the following cycle of operations, and said operating means comprising; a first valve operating means to close the valves of one of said pairs and open the valves of the other of said pairs, a first driving means to then move the dividing member to cause the volume of said first chamber to increase and the volume of said second chamber to decrease, a second valve operating means to then close the valves of the other of said pairs and open the valves of said one pair, and a second driving means to then move the dividing member to cause the volume of said first chamber to decrease and the volume of said second chamber to increase.

8. An apparatus according to claim 7 wherein said cycle of operations includes a stage wherein the valves of both of said pairs are closed and means are provided to cause said energy storage means to operate while said valves are closed.

9. An apparatus as claimed in claim 1 wherein the energy storage means is adapted to receive and store energy derived from the strain energy of the first volume.

10. An apparatus as claimed in claim 9 wherein the energy storage means is adapted to convert said strain energy to kinetic energy.

11. An apparatus as claimed in claim 10 wherein the energy storage means comprises a rotatable energy storage member, means to rotate said member by means of a force derived from said energy of the first volume and means subsequently to cause continuing rotation of the rotatable member to provide a force to pressurize the second volume.

12. An apparatus as claimed in claim 11 wherein means are provided to vary the inertia and/or speed of rotation of the rotatable member.

13. An apparatus as claimed in claim 11 wherein the liquid of the first volume acts on a piston, movement of the piston being utilized to rotate the energy storage member.

14. An apparatus as claimed in claim 13 wherein said continuing rotation of the energy storage member moves a pressurizing piston to cause the piston to impose a pressurizing force on the liquid of the second volume.

15. An apparatus as claimed in claim 14 wherein the pressurizing piston drives the rotatable member through a rack provided on the piston in engagement with a pinion drivingly connected to the rotatable member.

16. An apparatus as claimed in claim 15 wherein the rotatable member drives the pressurizing piston by virtue of a rack provided on the pressurizing piston in engagement with a pinion driven from the rotatable member.

17. An apparatus as claimed in claim 16 wherein a common rack and pinion is provided, the rack having at one end a driven piston in driving relationship with the liquid of the first volume and at the other end the pressurizing piston in pressurizing relationship with the liquid of the second volume.

* * * * *

UNITED STATES PATENT AND TRADEMARK OFFICE

CERTIFICATE OF CORRECTION

PATENT NO. : 5,131,819

DATED : July 21, 1992

INVENTOR(S) : Albert Jubb

It is certified that error appears in the above-identified patent and that said Letters Patent is hereby corrected as shown below:

Cover page, after [73] Assignee: "Norhamptonshire" should read --Northamptonshire--.

Column 3 Line 11 "storage" should read --stored--.

Column 5 Line 45 after "permit" delete --of--.

Column 5 Line 66 "valve" (second occurrence) should read --valves--.

Column 6 Line 6 "C1a" should read --C1b--.

Column 6 Line 8 "16a" should read --16b--.

Column 6 Line 10 "52a" should read --52b--.

Column 6 Line 13 after "H" insert --.--.

Column 6 Line 25 "affect" should read --effect--.

Column 6 Line 28 "affect" should read --effect--.

UNITED STATES PATENT AND TRADEMARK OFFICE

CERTIFICATE OF CORRECTION

PATENT NO. : 5,131,819

DATED : July 21, 1992

INVENTOR(S) : Albert Jubb

It is certified that error appears in the above-identified patent and that said Letters Patent is hereby corrected as shown below:

Column 7 Line 53 "52a, 52a" should read --52a, 52b--.

Column 8 Line 26 "52a, 52a" should read --52a, 52b--.

Column 9 Line 25 "P" should read --PW--.

Column 9 Line 59 "pistion" should read --piston--.

Column 12 Line 9 "deverse" should read --diverse--.

Signed and Sealed this

Fifth Day of October, 1993

*Attest:*

Bruce Lehman

BRUCE LEHMAN

*Attesting Officer*

*Commissioner of Patents and Trademarks*